US012753347B2

(12) United States Patent
Holcombe et al.

(10) Patent No.: US 12,753,347 B2
(45) Date of Patent: Oct. 6, 2026

(54) SYSTEM AND PROCESS FOR INCREASING A SOFTENING POINT OF ISOTROPIC PITCH

(71) Applicant: ACP Technologies, LLC, St. Clair Shores, MI (US)

(72) Inventors: Thomas C. Holcombe, Hillsborough, NJ (US); David Christian Boyer, Palm Coast, FL (US); Lane Malone, Grayson, KY (US); Dominic Lucchi, Royal Oak, MI (US)

(73) Assignee: ACP TECHNOLOGIES, LLC, St. Clair Shores, MI (US)

( * ) Notice: Subject to any disclaimer, the term of this patent is extended or adjusted under 35 U.S.C. 154(b) by 334 days.

(21) Appl. No.: 18/372,235

(22) Filed: Sep. 25, 2023

(65) Prior Publication Data

US 2025/0101313 A1 Mar. 27, 2025

(51) Int. Cl.
*C10C 3/04* (2006.01)

(52) U.S. Cl.
CPC ..... *C10C 3/04* (2013.01)

(58) Field of Classification Search
CPC ..... C10C 3/04; C10C 3/002
See application file for complete search history.

(56) References Cited

U.S. PATENT DOCUMENTS 3,713,629 A * 1/1973 Rieter ..... B01D 47/06 261/112.1
7,220,348 B1 5/2007 Malone et al.
9,222,027 B1 12/2015 Malone et al.
9,376,626 B1 6/2016 Malone et al.
9,551,526 B2 1/2017 Betting et al.
10,731,084 B1 8/2020 Malone et al.
11,193,070 B1 12/2021 Boyer et al.
11,319,491 B1 5/2022 Holcombe et al.
2014/0374310 A1* 12/2014 Aldous ..... C10C 3/04 208/6

FOREIGN PATENT DOCUMENTS

WO 2009/074837 A1 6/2009

OTHER PUBLICATIONS

A Model for Predicting Flow Regime Transitions in Horizontal and Near Horizontal Gas-Liquid Flow; Yemada Taitel and A.E. Dukler; Jan. 1976; 9 pages.

* cited by examiner

*Primary Examiner* — Randy Boyer
*Assistant Examiner* — Juan C Valencia
(74) *Attorney, Agent, or Firm* — David Guerra

(57) ABSTRACT

A process for increasing a softening point of isotropic pitch includes providing a hydrocarbon feed including isotropic pitch having a first softening point and mixing the hydrocarbon feed with a carrier gas such that a mixture of the hydrocarbon feed and the carrier gas establishes at least one chosen from an annular-mist flow regime and a mist flow regime. The annular-mist flow regime includes a liquid film layer and a dispersion of entrained droplets, and the mist flow regime includes a dispersion of entrained droplets. The mixture of the hydrocarbon feed and the carrier gas approaches a vapor-liquid equilibrium. The process also includes discharging an effluent of the mixture into a separation vessel and separating a vapor phase and a liquid phase in the separation vessel. The liquid phase includes isotropic pitch having a second softening point greater than the first softening point.

19 Claims, 4 Drawing Sheets

SYSTEM AND PROCESS FOR INCREASING A SOFTENING POINT OF ISOTROPIC PITCH

BACKGROUND OF THE INVENTION

1. Field of the Invention

The invention generally relates to a system and a process for increasing a softening point of isotropic pitch.

2. Description of the Related Art

Some hydrocarbon feedstocks, such as oils, commonly contain heavy fractions known as pitch. Pitch has a high carbon content and is useful for binding other carbon-containing materials together. To separate pitch from oil, simple distillation or vacuum distillation are typically used. To increase the amount of pitch generated or recovered from a given amount of hydrocarbon feedstock, it is common to convert a portion of the hydrocarbon feedstock to pitch through thermal polymerization, thermal cracking, thermal dealkylation, visbreaking, and/or short residence contact processes such as wiped film evaporation in conjunction with distillation. More specifically, when hydrocarbon feedstocks are converted to pitch, the hydrocarbon feedstock is heated to induce thermal polymerization and form, at first, isotropic pitch. Isotropic pitches converted through conventional processes commonly have relatively low softening points, typically around 40-120 degrees centigrade. The softening point of isotropic pitch can vary greatly depending upon the severity of the process (e.g., the temperatures and pressures involved).

If isotropic pitch were to continue to be heated and treated further (e.g., if the severity of the process were to be increased), the isotropic pitch would form mesophase pitch. Mesophase pitch is a liquid with crystal properties. Although mesophase pitch has properties which make it useful for certain applications (e.g., the production of carbon fiber, graphitic microbeads for lithium-ion batteries, graphitic foam, etc.), mesophase pitch is considered an undesired impurity when producing isotropic pitch for other applications where the presence of even modest amounts of mesophase pitch as an impurity could significantly reduce its commercial value. As such, the amount of heating used to produce isotropic pitch without producing mesophase pitch requires careful consideration.

To increase the softening point of isotropic pitch, it is necessary to remove lower molecular weight components from the isotropic pitch. Removal of lower molecular weight components typically involves heating the isotropic pitch to evaporate the lower molecular weight components. The challenge in increasing the softening point of isotropic pitch, therefore, is to remove the lower molecular weight components from the isotropic pitch while limiting the conversion of isotropic pitch to mesophase pitch. Conversion of isotropic pitch to mesophase pitch is largely a function of time and temperature, and thus pitch producers have typically attempted to limit the time or temperatures of the processes to limit formation of mesophase pitch. Pitch producers have traditionally resorted to using wiped film evaporators to reduce the time that the isotropic pitch is exposed to elevated temperatures or vacuum distillation to reduce the temperatures required. Both of these approaches incur high capital and operating costs.

As such, there remains a need to provide a new system and process for increasing a softening point of an isotropic pitch.

SUMMARY OF THE INVENTION AND ADVANTAGES

A process for increasing a softening point of isotropic pitch includes a step of providing a hydrocarbon feed including isotropic pitch having a first softening point and a step of mixing the hydrocarbon feed with a carrier gas such that a mixture of the hydrocarbon feed and the carrier gas establishes at least one chosen from an annular-mist flow regime and a mist flow regime. The annular-mist flow regime includes a liquid film layer and a dispersion of entrained droplets, and the mist flow regime includes a dispersion of entrained droplets. The mixture of the hydrocarbon feed and the carrier gas approaches a vapor-liquid equilibrium in the annular-mist flow regime and/or the mist flow regime. The process also includes a step of discharging an effluent of the mixture into a separation vessel. The process further includes the step of separating a vapor phase and a liquid phase from the effluent in the separation vessel. The liquid phase includes isotropic pitch having a second softening point greater than the first softening point.

Accordingly, establishment of either or both of the annular-mist flow regime and the mist flow regime, and approach of the vapor-liquid equilibrium causes the more volatile compounds in the hydrocarbon feed to enter the vapor phase. The isotropic pitch in the liquid phase, therefore, has the second softening point greater than the first softening point because the more volatile compounds have been removed. Establishment of either of the annular-mist flow regime and the mist flow regime is effective in limiting the amount of time required to approach the vapor-liquid equilibrium. Moreover, the process is able to produce the isotropic pitch having the second softening point greater than the first softening point in a commercially viable, low-cost manner.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
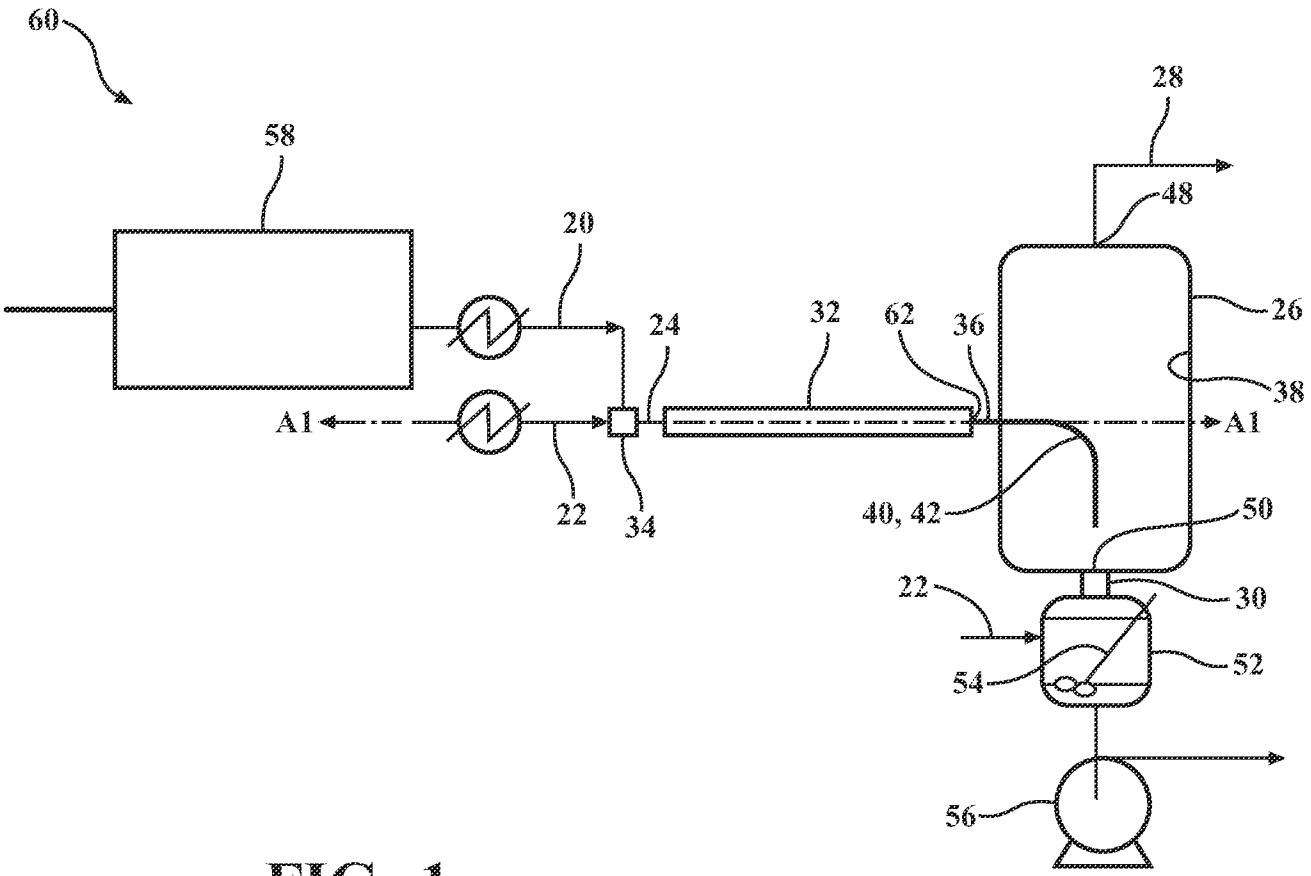
FIG. 1 is a schematic illustration of the system including a laminar tube having a coalescence portion, with the coalescence portion including a bend.

With reference to the Figures, wherein like numerals indicate like parts throughout the several views, a process 10 for increasing a softening point of isotropic pitch is provided. The process 10 includes a step 12 of providing a hydrocarbon feed 20 including isotropic pitch having a first softening point and a step 14 of mixing the hydrocarbon feed 20 with a carrier gas 22 such that a mixture 24 of the hydrocarbon feed 20 and the carrier gas 22 establishes at least one chosen from an annular-mist flow regime and a mist flow regime. In other words, the mixture 24 of the hydrocarbon feed 20 and the carrier gas 22 may establish an annular-mist flow regime, also referred to herein as an annular flow regime, the mixture 24 may establish a mist flow regime, or the mixture 24 may establish both an annular-mist flow regime and a mist flow regime at different times in the process 10. The annular-mist flow regime includes a liquid film layer and a dispersion of entrained droplets, and the mist flow regime includes a dispersion of entrained droplets. It is to be appreciated that in the mist flow regime all, or nearly all, of the hydrocarbon feed 20 is entrained as droplets in the carrier gas 22.

The mixture 24 of the hydrocarbon feed 20 and the carrier gas 22 approaches a vapor-liquid equilibrium. The mixture 24 of the hydrocarbon feed 20 and the carrier gas 22 need not reach an exact vapor-liquid equilibrium. The process 10 also includes a step 16 of discharging an effluent 62 of the mixture 24 into a separation vessel 26 and a step 18 of separating a vapor phase 28 and a liquid phase 30 in the separation vessel 26. The liquid phase 30 includes isotropic pitch having a second softening point greater than the first softening point.

Accordingly, establishment of either or both of the annular-mist flow regime and the mist flow regime, and approach of the vapor-liquid equilibrium causes the more volatile compounds in the hydrocarbon feed 20 to enter the vapor phase 28. The isotropic pitch in the liquid phase 30, therefore, has the second softening point greater than the first softening point because the more volatile compounds have been removed. Establishment of either of the annular-mist flow regime and the mist flow regime is effective in limiting the amount of time required to approach the vapor-liquid equilibrium, particularly because surface to volume ratios of the hydrocarbon feed 20 are high. Moreover, the process is capable of producing the isotropic pitch having the second softening point greater than the first softening point in a commercially viable, low-cost manner.

As described herein, the liquid phase 30 includes isotropic pitch having a second softening point greater than the first softening point. The first softening point and the second softening point may be measured according to ASTM D3104-14a. As non-limiting examples, the second softening point may be between about 1 degree centigrade and about 100 degrees centigrade greater than the first softening point, may be between about 1 degree centigrade and about 50 degrees centigrade greater than the first softening point, may be between about 1 degree centigrade and about 40 degrees centigrade greater than the first softening point, may be between about 1 degree centigrade and about 30 degrees greater than the first softening point, may be between about 1 degree centigrade and about 25 degrees centigrade greater than the first softening point, may be between about 1 degree centigrade and about 20 degrees centigrade greater than the first softening point, may be between about 1 degree centigrade and about 15 degrees centigrade greater than the first softening point, may be between about 1 degree centigrade and about 10 degrees centigrade greater than the first softening point, or may be between about 1 degree centigrade and about 5 degrees centigrade greater than the first softening point. Moreover, as additional non-limiting examples, the second softening point may be between about 5 degrees centigrade and about 100 degrees centigrade greater than the first softening point, may be between about 5 degrees centigrade and about 50 degrees centigrade greater than the first softening point, may be between about 5 degrees centigrade and about 40 degrees centigrade greater than the first softening point, may be between about 5 degrees centigrade and about 30 degrees centigrade greater than the first softening point, may be between about 5 degrees centigrade and about 25 degrees centigrade greater than the first softening point, may be between about 5 degrees centigrade and about 20 degrees centigrade greater than the first softening point, may be between about 5 degrees centigrade and about 15 degrees centigrade greater than the first softening point, or may be between about 5 degrees centigrade and about 10 degrees centigrade greater than the first softening point.

Moreover, the second softening point may be at least 1 degree centigrade greater than the first softening point, may be at least 5 degrees centigrade greater than the first softening point, may be at least 10 degrees centigrade greater than the first softening point, may be at least 15 degrees centigrade greater than the first softening point, may be at least 20 degrees centigrade greater than the first softening point, may be at least 25 degrees centigrade greater than the first softening point, may be at least 30 degrees centigrade greater than the first softening point, may be at least 40 degrees centigrade greater than the first softening point, or may be at least 50 degrees centigrade greater than the first softening point.

Although not required, the isotropic pitch in the liquid phase 30 may have a second softening point of between about 130 degrees centigrade and about 300 degrees centigrade. Additionally, the isotropic pitch in the liquid phase 30 may have a second softening point of between about 140 degrees centigrade and about 300 degrees centigrade, between about 150 degrees centigrade and about 300 degrees centigrade, between about 160 degrees centigrade and about 300 degrees centigrade, between about 170 degrees centigrade and about 300 degrees centigrade, between about 180 degrees centigrade and about 300 degrees centigrade, between about 190 degrees centigrade and about 300 degrees centigrade, between about 200 degrees centigrade and about 300 degrees centigrade, between about 210 degrees centigrade and about 300 degrees centigrade, between about 220 degree centigrade and about 300 degrees centigrade, between about 230 degrees centigrade and about 300 degrees centigrade, between about 240 degrees centigrade and about 300 degrees centigrade, between about 250 degrees centigrade and about 300 degrees centigrade, between about 260 degrees centigrade and about 300 degrees centigrade, between about 270 degrees centigrade and about 300 degrees centigrade, between about 280 degrees centigrade and about 300 degrees centigrade and between about 290 degrees centigrade and about 300 degrees centigrade.

Moreover, the isotropic pitch in the liquid phase 30 may have a second softening point of at least 130 degrees centigrade, of at least 140 degrees centigrade, of at least 150 degrees centigrade, of at least 160 degrees centigrade, of at least 170 degrees centigrade, of at least 180 degrees centigrade, of at least 190 degrees centigrade, of at least 200 degrees centigrade, of at least 210 degrees centigrade, of at least 220 degrees centigrade, of at least 230 degrees centigrade, of at least 240 degrees centigrade, of at least 250 degrees centigrade, of at least 260 degrees centigrade, of at least 270 degrees centigrade, of at least 280 degree centigrade, of at least 290 degrees centigrade, or of at least 300 degrees centigrade.

Additionally, although also not required, the isotropic pitch provided in the hydrocarbon feed 20 may have a first softening point of less than about 160 degrees centigrade. Additionally, the isotropic pitch provided in the hydrocarbon feed 20 may have a first softening point of less than about 155 degrees centigrade, less than about 150 degrees centigrade, less than about 145 degrees centigrade, less than about 140 degrees centigrade, less than about 135 degrees centigrade, less than about 130 degrees centigrade, less than about 125 degrees centigrade, less than about 120 degrees centigrade, less than about 115 degrees centigrade, less than about 110 degrees centigrade, less than about 105 degrees centigrade, and less than about 100 degrees centigrade.

The carrier gas 22 may include any non-oxidizing, inert gas. The carrier gas 22 may include, but is not limited to, steam including superheated steam, nitrogen, oxygen, argon, vaporized hydrocarbons including light distillates such as alkanes and distillate boiling range materials, and combinations thereof. The hydrocarbon feed 20 may be from a variety of sources given that it includes isotropic pitch. Further discussion of sources of the hydrocarbon feed 20 is detailed below.

The liquid phase 30 may include only a limited amount of mesophase pitch. More specifically, the liquid phase 30 may include less than about 5 volume percentage mesophase pitch. The liquid phase 30 may also include less than about 4 volume percentage mesophase pitch, less than about 3 volume percentage mesophase pitch, less than about 2 volume percentage mesophase pitch, less than about 1 volume percentage mesophase pitch, less than about 0.5 volume percentage mesophase pitch, less than about 0.4 volume percentage mesophase pitch, less than about 0.3 volume percentage mesophase pitch, less than about 0.2 volume percentage mesophase pitch, or even less than about 0.1 volume percentage mesophase pitch. It is to be appreciated that the liquid phase 30 may include little to no detectable mesophase pitch. Additionally, although not required, the liquid phase 30 may include at least about 0.1 volume percentage mesophase pitch.

As described herein, mesophase pitch is a potential impurity which may result when producing isotropic pitch. Even modest amounts of mesophase pitch may destroy the commercial value of the isotropic pitch for some applications. More specifically, mesophase pitch may be produced upon heating and further treatment of the isotropic pitch. It is to be appreciated that, therefore, the liquid phase 30 including only a limited amount of mesophase pitch while including the isotropic pitch with the second softening point greater than the first softening point of the isotropic pitch of the hydrocarbon feed 20 is a notable achievement. Although further treatment of the hydrocarbon feed is undergone, in some embodiments at elevated temperatures, it has been found that mesophase pitch is not produced. Although not intending to be bound by theory, it is theorized that mesophase pitch formation occurs primarily when the hydrocarbon feed 20 is a liquid. As such, to limit formation of the mesophase pitch, the amount of liquid may be minimized.

The temperature of the equilibrium channel 32 may be about 250 degrees centigrade to about 500 degrees centigrade. Moreover, the temperature of the equilibrium channel 32 may be about 300 degrees centigrade to about 500 degrees centigrade, about 350 degrees centigrade to about 450 degrees centigrade, about 370 degrees centigrade to about 430 degrees centigrade, about 380 degrees centigrade to about 420 degrees centigrade, about 390 degrees centigrade to about 410 degrees centigrade, or about 400 degrees centigrade. The pressure in the equilibrium channel may range from about 10 PSIG to about 50 PSIG, about 10 PSIG to about 40 PSIG, about 10 PSIG to about 30 PSIG, or about 10 PSIG to about 25 PSIG.

The step 14 of mixing the hydrocarbon feed 20 with the carrier gas 22 may be accomplished at a mix point 34. The mix point 34 may include an atomizer to atomize the hydrocarbon feed 20 prior to, or concurrently with, mixing with the carrier gas 22. The step 14 of mixing the hydrocarbon feed 20 with the carrier gas 22 may include flowing the hydrocarbon feed 20 and the carrier gas 22 through an equilibrium channel 32 to establish at least one chosen from the annular-mist flow regime and the mist flow regime. The equilibrium channel 32 may be a pipe, a tube, a duct, or the like. The equilibrium channel 32 ensures thorough mixing and intimate contact between the hydrocarbon feed 20 and the carrier gas 22. The equilibrium channel 32 also limits the amount of the carrier gas 22 required for a given increase in softening point of the isotropic pitch.

The equilibrium channel 32 defines a geometric center, and the step 14 of mixing the hydrocarbon feed 20 with the carrier gas 22 may include introducing the hydrocarbon feed 20 near the geometric center of the equilibrium channel 32. It is to be appreciated that the hydrocarbon feed 20 may be introduced exactly at the geometric center of the equilibrium channel 32 and still be considered as being introduced near the geometric center of the equilibrium channel 32.

The flow of the hydrocarbon feed 20 and the carrier gas 22 through the equilibrium channel 32 may be in a turbulent regime having a Reynolds number of at least about 3000. The flow of the hydrocarbon feed 20 and the carrier gas 22 through the equilibrium channel 32 may be in a turbulent regime having a Reynolds number of at least about 3500, of at least about 4000, of at least about 5000, of at least about 6000, of at least about 7000, of at least about 8000, of at least about 9000, of at least about 10,000, of at least about 15,000, of at least about 20,000, of at least about 25,000, of at least about 30,000, of at least about 35,000, of at least about 40,000, of at least about 45,000, of at least about 50,000, of at least about 60,000, of at least about 70,000, of at least about 80,000, of at least about 90,000, of at least about 100,000, or of at least about 115,000. The turbulent regime improves mixing between the hydrocarbon feed 20 and the carrier gas 22. Moreover, although not required, the flow of the hydrocarbon feed 20 and the carrier gas 22 through the equilibrium channel 32 may be in a turbulent regime having a Reynolds number of less than about 250,000.

Moreover, it is to be appreciated that the conditions required to achieve the annular-mist flow regime or the mist flow regime through the equilibrium channel 32 depend upon, inter alia, the velocity of the flow of the carrier gas 22 through the equilibrium channel 32 and the diameter of the equilibrium channel 32. It should be noted that the minimum velocity of the flow of the carrier gas 22 necessary to establish the annular-mist flow regime or the mist flow regime at low flow rates of the hydrocarbon feed 20 increases with increased diameters of the equilibrium channel 32, and the associated Reynolds number increases even faster. As a non-limiting example, an annular-mist flow regime was established in an equilibrium channel 32 having a diameter of about 1.25 centimeters with a velocity of the flow of the carrier gas 22 about 25 meters per second and having an associated Reynolds number of about 6,000. Compared with another non-limiting example, where an annular-mist flow regime was established in an equilibrium channel 32 having a diameter of about 30 centimeters with a velocity of the flow of the carrier gas 22 about 100 meters per second and having an associated Reynolds number of about 115,000, it is clear that increasing the diameter of the equilibrium channel 32 requires higher velocities of the flow of the carrier gas 22 and result in even higher Reynolds numbers.

The flow of the hydrocarbon feed 20 and the carrier gas 22 may travel at least about one foot through the equilibrium channel 32. It is to be appreciated that the flow of the hydrocarbon feed 20 and the carrier gas 22 may travel at least about two feet through the equilibrium channel 32, at least about three feet through the equilibrium channel 32, at least about four feet through the equilibrium channel 32, at least about five feet through the equilibrium channel 32, at least about six feet through the equilibrium channel 32, at least about seven feet through the equilibrium channel 32, at least about eight feet through the equilibrium channel 32, at least about nine feet through the equilibrium channel 32, at least about ten feet through the equilibrium channel 32, at least about fifteen feet through the equilibrium channel 32, or at least about twenty feet through the equilibrium channel 32.

Moreover, the flow of the hydrocarbon feed 20 and the carrier gas 22 may travel between about one foot and about 20 feet through the equilibrium channel 32, between about two feet and 20 feet through the equilibrium channel 32, between about two feet and about fifteen feet through the equilibrium channel 32, between about two feet and about ten feet through the equilibrium channel 32, between about two feet and about eight feet through the equilibrium channel 32, between about three feet and about seven feet through the equilibrium channel 32, or between about four feet and about six feet through the equilibrium channel 32.

As such, the equilibrium channel 32 may be relatively short (e.g., about one foot) or may be relatively long (e.g., between about 50 feet and about 100 feet). The length of the equilibrium channel 32, and thus the distance that the flow of the hydrocarbon feed 20 and the carrier gas 22 travels through the equilibrium channel 32, impacts the residence time of the hydrocarbon feed 20. The length of the equilibrium channel 32 necessary to approach the vapor-liquid equilibrium is dependent upon the temperatures and the velocities of the hydrocarbon feed 20 and the carrier gas 22, among other variables. The flow of the carrier gas 22 may travel through the equilibrium channel 32 in less than about one second to limit formation of mesophase pitch. As such, it is to be understood that the flow of the carrier gas 22 has a relatively high velocity. The flow of the hydrocarbon feed 20 need not have as high of a velocity as the flow of the carrier gas 22, and thus the flow of the hydrocarbon feed 20 may travel through the equilibrium channel 32 in more than about one second.

The process 10 may further include the step of coalescing the dispersion of entrained droplets with the liquid film layer prior to separating the vapor phase 28 and the liquid phase 30. The step 16 of discharging the effluent 62 into the separation vessel 26 may include flowing the effluent 62 in a laminar flow regime through a laminar tube 32 having an inner surface on which the liquid film layer is disposed. The step of coalescing the dispersion of entrained droplets with the liquid film layer may include contacting the dispersion of entrained droplets with the liquid film layer on the inner surface of the laminar tube 36. It is to be appreciated that, if a mist flow regime is established, the step of coalescing the dispersion of entrained droplets with the liquid film layer may further include establishing a liquid film layer through facilitated contact of the dispersion of entrained droplets with the inner surface of the laminar tube 36, and thus the remaining entrained droplets would then coalesce with the liquid film layer.

The laminar tube 36 may extend along an axis Al into a vessel interior 38 defined by the separation vessel 26. The laminar tube 36 may also include a coalescence portion 40 to facilitate contact of the dispersion of entrained droplets with the liquid film layer on the inner surface of the laminar tube 36. The coalescence portion 40 may be embodied by a variety of shapes and configurations, all of which facilitate contact of the dispersion of entrained droplets with the liquid film layer on the inner surface of the laminar tube 36. Although not intending to be bound by theory, it is theorized that centrifugal forces in the coalescence portion 40 causes the dispersion of entrained droplets to hit the inner wall of the coalescence portion 40 and remix with the liquid film layer. In some embodiments, the coalescence portion 40 includes at least one chosen from a bend 42 angled at least about 30 degrees relative to the axis A1 and a pigtail 44 forming at least one loop 46. Said differently, the coalescence portion 40 may include the bend 42, the pigtail 44, or both the bend 42 and the pigtail 44.

Figure 2:
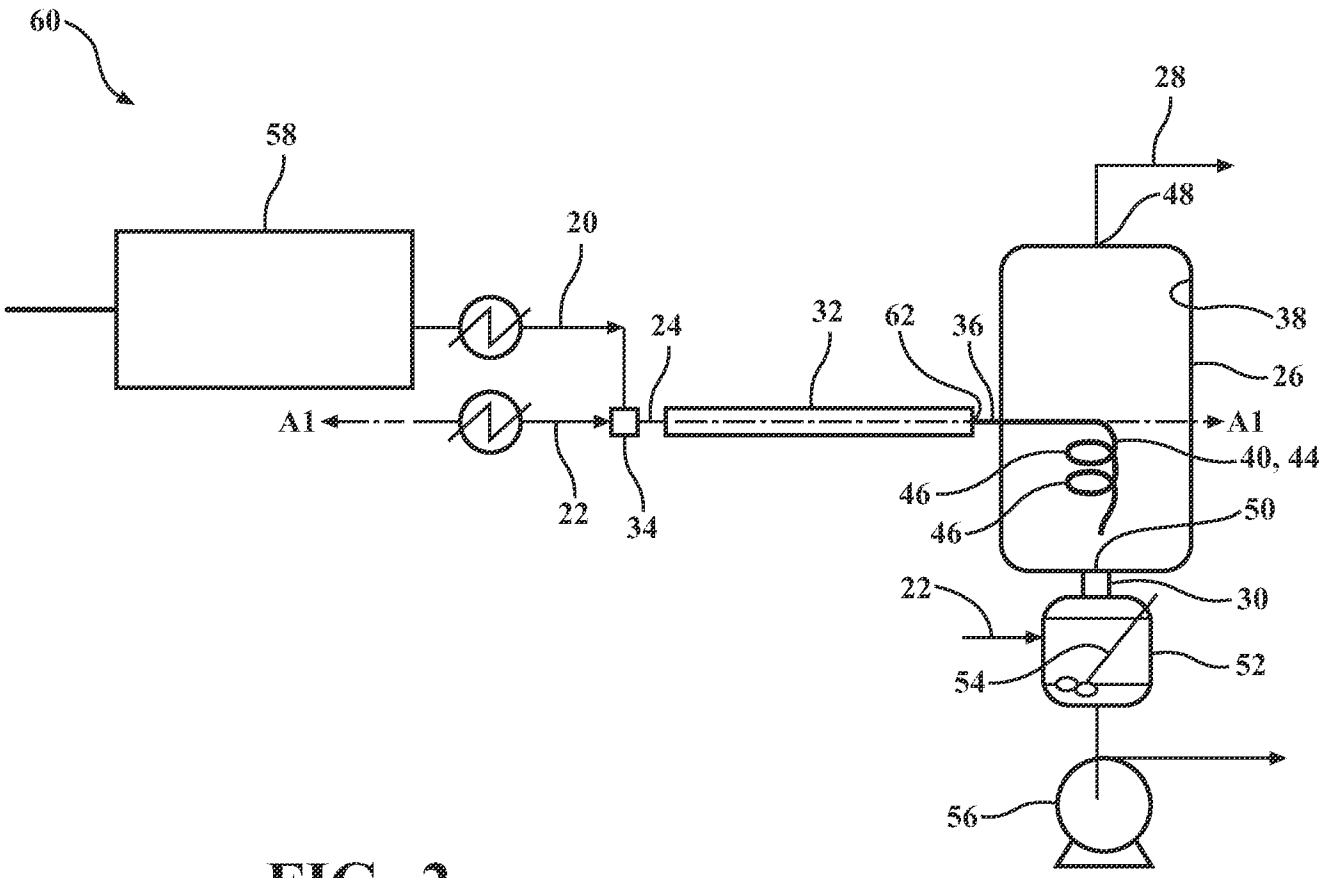
FIG. 2 is a schematic illustration of another embodiment of the system, with the system including the laminar tube having the coalescence portion, with the coalescence portion including a pigtail with two loops.
Figure 3:
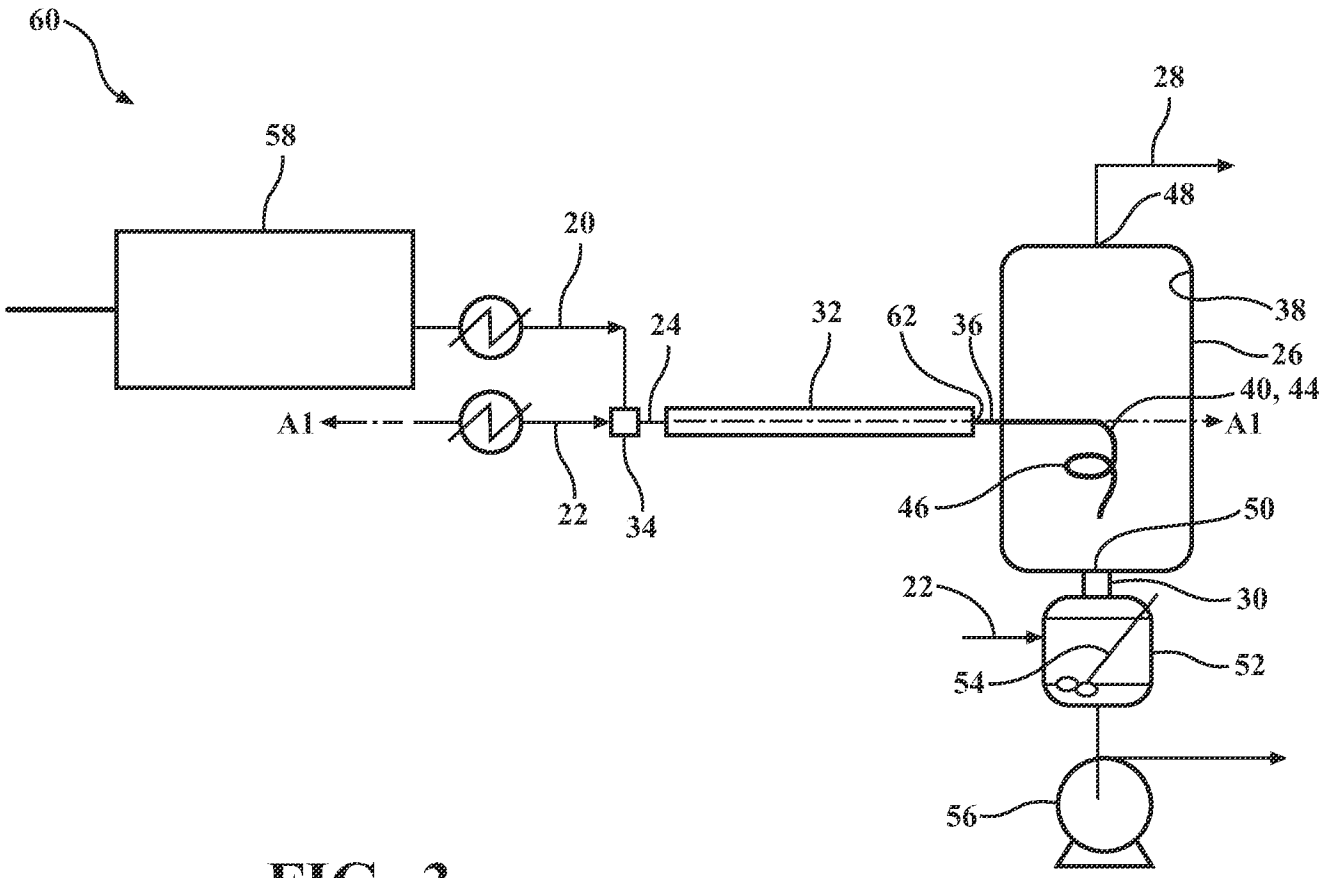
FIG. 3 is a schematic illustration of another embodiment of the system, with the system including the laminar tube having the coalescence portion, with the coalescence portion including a pigtail with one loop.
Figure 4:
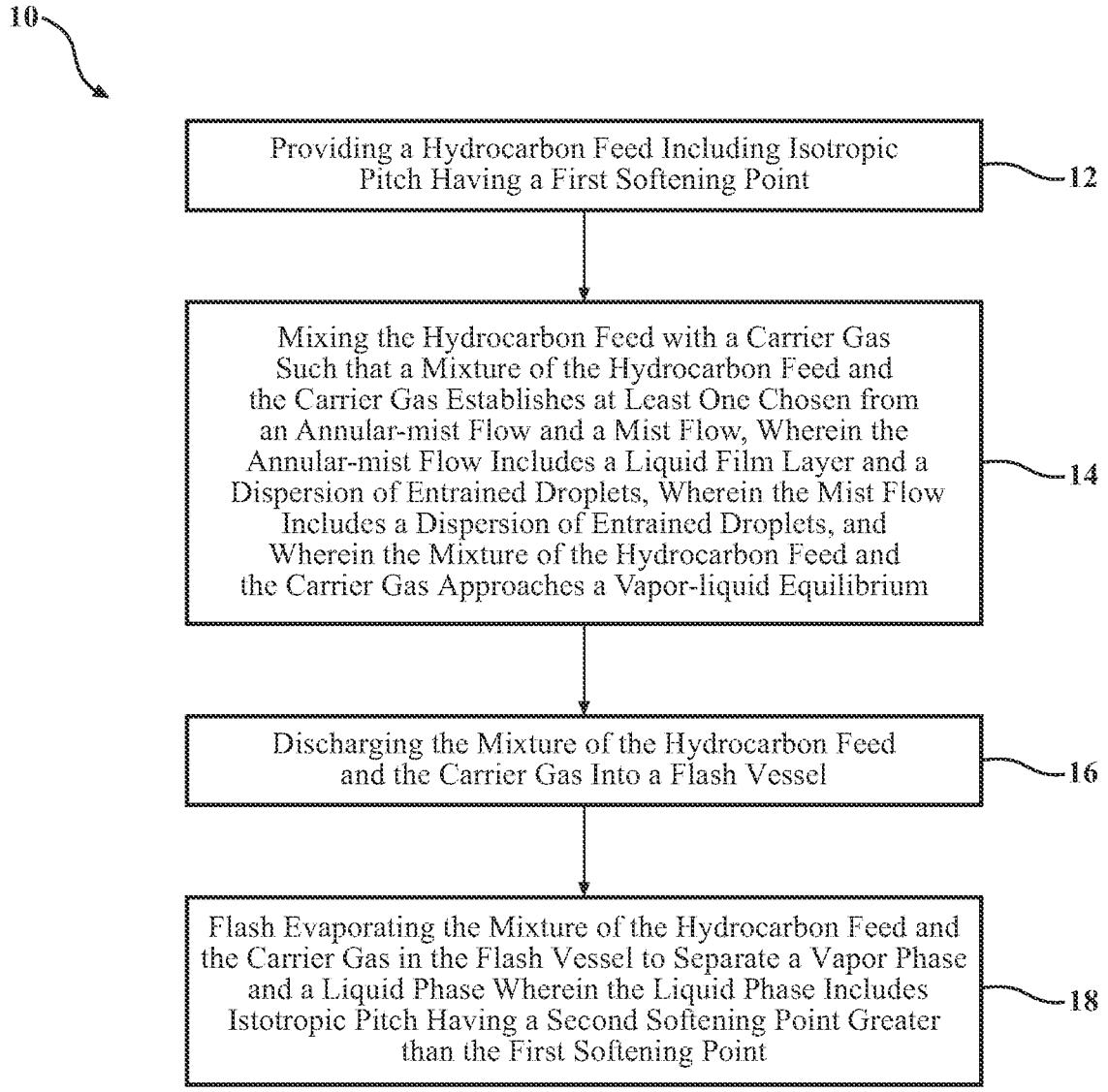
FIG. 4 is a flowchart of a process for increasing a softening point of isotropic pitch.

As shown in FIG. 1, the bend 42 may be more than about 30 degrees relative to the axis A1. In non-limiting examples, the bend 42 may be more than about 40 degrees relative to the axis A1, more than about 50 degrees relative to the axis A1, more than about 60 degrees relative to the axis A1, more than about 70 degrees relative to the axis A1, more than about 80 degrees relative to the axis A1, about 90 degrees relative to the axis A1 (i.e., a right angle), or even may be more than about 90 degrees relative to the axis A1. It is to be appreciated that the bend 42 may include linear portions adjacent either side of the bend 42. The pigtail 44 may form one loop 46, as shown in FIG. 3, or may form more than one loop 46, as shown in FIG. 2. The loop 46 may double back along the axis A1 or may spiral about the axis A1.

The coalescence portion 40 may be disposed in the vessel interior 38 of the separation vessel 26. However, it is to be appreciated that the coalescence portion 40 may alternatively be disposed exterior to the separation vessel 26 or may even be disposed partially within the vessel interior 38 of the separation vessel 26 and also partially exterior to the separation vessel 26.

More specifically, the separation vessel 26 includes a vapor outlet 48 to discharge the vapor phase 28 from the separation vessel 26 and the separation vessel 26 includes a liquid outlet 50 to discharge the liquid phase 30 from the separation vessel 26. As described herein, the coalescence portion 40 may be disposed in the vessel interior 38. Further, the coalescence portion 40 may be arranged to direct the effluent 62 toward the liquid outlet 50. The liquid outlet 50 is typically proximal to the ground so that the coalescence portion 40 may be assisted by gravity in directing the flow of the effluent 62 toward the liquid outlet 50.

The step of coalescing the dispersion of entrained droplets with the liquid film layer may include flowing the effluent 62 such that the effluent 62 establishes at least one chosen from a stratified flow regime, a slug flow regime, a plug flow regime, and a bubble flow regime to limit formation of additional entrained droplets. In other words, the step of coalescing the dispersion of entrained droplets with the liquid film layer may include flowing the effluent 62 such that the effluent 62 establishes a stratified flow regime, a slug flow regime, a plug flow regime, a bubble flow regime, or any combination thereof at different times in the process 10. The stratified flow regime, the slug flow regime, the plug flow regime, and the bubble flow regime all limit the formation of additional entrained droplets which may leave through the vapor outlet 48. The stratified flow regime, the slug flow regime, the plug flow regime, and the bubble flow regime may each, or all, be accomplished by the coalescence portion 40 having a relatively large diameter. In other words, the coalescence portion 40 has a diameter larger than the diameter of the equilibrium channel 32.

Although not required, the separation vessel 26 may operate at conditions between about 250 degrees centigrade and about 500 degrees centigrade to limit formation of mesophase pitch. Moreover, the separation vessel 26 may operate at conditions between about 300 degrees centigrade and about 500 degrees centigrade, between about 350 degrees centigrade and about 500 degrees centigrade, between about 400 degrees centigrade and about 500 degrees centigrade, between about 450 degrees centigrade and about 500 degrees centigrade, between about 250 degrees centigrade and about 450 degrees centigrade, between about 300 degrees centigrade and about 450 degrees centigrade, between about 350 degrees centigrade and about 450 degrees centigrade, between about 400 degrees centigrade and about 450 degrees centigrade, between about 250 degrees centigrade and about 400 degrees centigrade, between about 300 degrees centigrade and about 400 degrees centigrade, and about 350 degrees centigrade and about 400 degrees centigrade. The separation vessel 26 operating at conditions between about 250 degrees centigrade and about 500 degrees centigrade assists in limiting formation of mesophase pitch. As discussed herein, the formation of mesophase pitch is a function of, inter alia, time and temperature. As such, by limiting the temperature of the separation vessel 26, the temperature of the effluent 62 is also limited, and thus mesophase pitch formation is similarly limited.

The process 10 may further include the step of flowing the liquid phase 30 directly into a quench drum 52 without accumulating the liquid phase 30 in the separation vessel 26. It is to be appreciated that flowing the liquid phase 30 directly into the quench drum 52 without accumulating the liquid phase in the separation vessel 26 may be accomplished in combination with the coalescence portion 40 directing the effluent 62 toward the liquid outlet 50. The process 10 may also include the step of lowering a temperature of the liquid phase 30 in the quench drum 52 to limit formation of mesophase pitch. The quench drum 52 may lower the temperature of the liquid phase 30 and may itself being relatively cool, and the temperature of the quench drum 52 may be controlled via heaters/coolers or insulation. Moreover, the quench drum 52 may include a mixer 54 to assist in mixing the relatively hot liquid phase 30 from the separation vessel 26 with relatively cool liquid phase 30 already present in the quench drum 52. Further still, the quench drum 52 may include an internal cooler disposed within the quench drum 52, such as a controlled thermal fluid passing through a coil, which can be used to further lower the temperature of the liquid phase 30.

As discussed herein, the formation of mesophase pitch is a function of, inter alia, time and temperature. As such, by limiting the temperature of the liquid phase 30 in the quench drum 52, mesophase pitch formation is similarly limited. Moreover, flowing the liquid phase 30 directly into the quench drum 52 without accumulating the liquid phase 30 in the separation vessel 26 limits the amount of time that the liquid phase 30 is subjected to elevated temperatures.

The process 10 may also further include the step of injecting additional carrier gas 22 into the quench drum 52 to ensure a vapor seal is maintained between the quench drum 52 and the separation vessel 26. The additional carrier gas 22 injected into the quench drum 52 to ensure the vapor seal is maintained between the quench drum 52 and the separation vessel 26 may be the same type of carrier gas 22 (e.g., steam, superheated steam, nitrogen, etc.) which is mixed with the hydrocarbon feed 20 to form the mixture 24. However, the additional carrier gas 22 injected into the quench drum 52 may be a different type of carrier gas 22 than the carrier gas 22 which is mixed with the hydrocarbon feed 20 to form the mixture 24. The step of injecting additional carrier gas 22 into the quench drum 52 to ensure the vapor seal is maintained prevents the vapor phase 28 from exiting the liquid outlet 50, which is particularly important in the embodiments where the coalescence portion 40 is arranged to direct the effluent 62 toward the liquid outlet 50. Instead, the vapor seal forces the vapor phase 28 to reverse direction and flow out of the vapor outlet 48. The process 10 may also include the step of withdrawing the liquid phase 30 from the quench drum 52, optionally via a pump 54. The additional carrier gas 22 injected into the quench drum 52 compensates for portions of the liquid phase 30 being withdrawn from the quench drum 52.

The process 10 as disclosed herein may be continuous (i.e., not a batch process). As a continuous process, the process 10 permits high throughput, low cost, and high-quality isotropic pitch with an increased softening point to be formed.

The hydrocarbon feed 20 may be provided from a holding tank or the like. However, in some embodiments, the hydrocarbon feed 20 may be provided from a reactor. More specifically, the step 12 of providing the hydrocarbon feed 20 including the isotropic pitch may further include the step of charging a feed including a distillate boiling range aromatic rich liquid to an inlet of a reactor, the step of converting the feed within the reactor at a temperature sufficiently high to induce thermal polymerization of the feed, at a pressure sufficient to maintain at least a majority by weight of the feed in a liquid phase, and for a time sufficient to convert at least a portion of the feed to isotropic pitch and boiling range material, and the step of discharging from the reactor an effluent stream including the isotropic pitch and the boiling range material. The effluent stream, in short, may be used to provide the hydrocarbon feed 20 in the process 10. The distillate boiling range aromatic rich liquid fed into the reactor may include, but is not limited to, slurry oil including filtered slurry oil and clarified slurry oil (e.g., from a catalytic cracking unit), main column bottoms, ethylene crackers including ethylene cracker bottoms, feedstocks such as oils, distillates, fractions, intermediates, bottoms, or solvated fractions of petroleum, coal, shale, steam crackers, cokers (either, or both, petroleum and coal), bio-oils, SATC (solvent extracted oils or fractions from petroleum and petroleum processes, coal, shale, and/or bio-oils), coal tar pitch, petroleum pitch, and other multi-ring aromatic compounds such as napthalene.

Moreover, the reactor 58 may operate at thermal conditions and for a time sufficient to convert at least 20 weight percent of the feed to the isotropic pitch. Such isotropic pitch may be provided using the process detailed in U.S. Pat. No. 9,222,027 B2, filed Mar. 11, 2013 and entitled "Single Stage Pitch Process and Product", the contents of which is hereby incorporated by reference in its entirety.

A system 60 for increasing a softening point of isotropic pitch is also provided. The system 60 includes a hydrocarbon feed 20 including isotropic pitch having a first softening point, and the system includes an equilibrium channel 32 configured to mix the hydrocarbon feed 20 with a carrier gas 22 such that at least one chosen from an annular mist-flow regime and a mist flow regime is established. The annular-mist flow regime has a liquid film layer and a dispersion of entrained droplets, and the mist flow regime has a dispersion of entrained droplets. The equilibrium channel 32 is configured to mix the hydrocarbon feed 20 with the carrier gas 22 such that the mixture 24 of the hydrocarbon feed 20 and the carrier gas 22 approaches a vapor-liquid equilibrium. The system also includes a separation vessel 26 defining a vessel interior 38 and configured to operate at conditions between about 250 degrees centigrade and about 500 degrees centigrade to limit formation of mesophase pitch. The separation vessel 26 includes a vapor outlet 48 to discharge a vapor phase 28 from the separation vessel 26, a liquid outlet 50 to discharge a liquid phase 30 from the separation vessel 26, and a laminar tube 36 extending along an axis A1 into the vessel interior 38. The laminar tube 36 is configured to receive the effluent 62 of the mixture 24 of the hydrocarbon feed 20 and the carrier gas 22. The laminar tube 36 also has an inner surface on which the liquid film layer is able to form and has a coalescence portion 40. The coalescence portion 40 includes at least one chosen from a bend 42 angled at least about 30 degrees relative to the axis A1 and a pigtail 44 forming at least one loop 46. The coalescence portion 40 is arranged to direct the effluent 62 toward the liquid outlet 50. The liquid phase 30 includes isotropic pitch having a second softening point greater than the first softening point.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A process for increasing a softening point of isotropic pitch, said process comprising:

providing a hydrocarbon feed including isotropic pitch having a first softening point;

mixing the hydrocarbon feed with a carrier gas such that a mixture of the hydrocarbon feed and the carrier gas establishes at least one chosen from an annular-mist flow regime and a mist flow regime, wherein the annular-mist flow regime includes a liquid film layer and a dispersion of entrained droplets, wherein the mist flow regime includes a dispersion of entrained droplets, and wherein the mixture of the hydrocarbon feed and the carrier gas approaches a vapor-liquid equilibrium;

discharging an effluent of the mixture into a separation vessel; and separating a vapor phase and a liquid phase from the effluent in the separation vessel;

wherein the liquid phase includes isotropic pitch having a second softening point greater than the first softening point, wherein the second softening point being between about 130 degrees centigrade and about 300 degrees centigrade.

2. The process of claim 1, wherein the first softening point of the isotropic pitch provided in the hydrocarbon feed is less than about 160 degrees centigrade.

3. The process of claim 1, wherein the liquid phase includes less than about 5 volume percentage mesophase pitch.

4. The process of claim 1, wherein the liquid phase includes less than about 2 volume percentage mesophase pitch.

5. The process of claim 1, wherein the step of mixing the hydrocarbon feed with the carrier gas includes flowing the hydrocarbon feed and the carrier gas through an equilibrium channel to establish at least one chosen from the annular-mist flow regime and the mist flow regime.

6. The process of claim 5, wherein the flow of the hydrocarbon feed and the carrier gas through the equilibrium channel is in a turbulent regime having a Reynolds number of at least about 3000.

7. The process of claim 5, wherein the flow of the hydrocarbon feed and the carrier gas travels at least about one foot through the equilibrium channel.

8. The process of claim 5, wherein the flow of the carrier gas travels through the equilibrium channel in less than about one second to limit formation of mesophase pitch.

9. The process of claim 1 further comprising the step of coalescing the dispersion of entrained droplets with the liquid film layer prior to separating the vapor phase and the liquid phase.

10. The process of claim 9, wherein the step of discharging the effluent into the separation vessel includes flowing the effluent in a laminar flow regime through a laminar tube having an inner surface on which the liquid film layer is disposed, and wherein the step of coalescing the dispersion of entrained droplets with the liquid film layer includes contacting the dispersion of entrained droplets with the liquid film layer on the inner surface of the laminar tube.

11. The process of claim 10, wherein the laminar tube extends along an axis into a vessel interior defined by the separation vessel and includes a coalescence portion to facilitate contact of the dispersion of entrained droplets with the liquid film layer on the inner surface of the laminar tube, with the coalescence portion including at least one chosen from a bend angled at least about 30 degrees relative to the axis and a pigtail forming at least one loop.

12. The process of claim 11, wherein the separation vessel includes a vapor outlet to discharge the vapor phase from the separation vessel and a liquid outlet to discharge the liquid phase from the separation vessel, and wherein the coalescence portion is disposed in the vessel interior and arranged to direct the effluent toward the liquid outlet.

13. The process of claim 9, wherein the step of coalescing the dispersion of entrained droplets with the liquid film layer includes flowing the effluent such that the effluent establishes at least one chosen from a stratified flow regime, a slug flow regime, a plug flow regime, and a bubble flow regime to limit formation of additional entrained droplets.

14. The process of claim 1, wherein the separation vessel operates at conditions between about 250 and about 500 degrees centigrade to limit formation of mesophase pitch.

15. The process of claim 1 further comprising the step of flowing the liquid phase directly into a quench drum without accumulating the liquid phase in the separation vessel, and the step of lowering a temperature of the liquid phase in the quench drum to limit formation of mesophase pitch.

16. The process of claim 15 further comprising the step of injecting additional carrier gas into the quench drum to ensure a vapor seal is maintained between the quench drum and the separation vessel.

17. The process of claim 1, wherein the step of providing the hydrocarbon feed including the isotropic pitch further includes:

charging a feed including a distillate boiling range aromatic rich liquid to an inlet of a reactor;

converting the feed within the reactor at a temperature sufficiently high to induce thermal polymerization of the feed, at a pressure sufficient to maintain at least a majority by weight of the feed in a liquid phase, and for a time sufficient to convert at least a portion of the feed to isotropic pitch and boiling range material; and discharging from the reactor an effluent stream comprising the isotropic pitch and the boiling range material.

18. The process of claim 17, wherein the reactor operates at thermal conditions and for a time sufficient to convert at least 20 weight percent of the feed to the isotropic pitch.

19. A system for increasing a softening point of isotropic pitch, said system comprising:

a hydrocarbon feed including isotropic pitch having a first softening point;

an equilibrium channel configured to mix said hydrocarbon feed with a carrier gas such that at least one chosen from an annular-mist flow regime and a mist flow regime is established, with said annular-mist flow regime having a liquid film layer and a dispersion of entrained droplets, with said mist flow regime having a dispersion of entrained droplets, and such that said mixture of said hydrocarbon feed and said carrier gas approaches a vapor-liquid equilibrium; and a separation vessel defining a vessel interior and configured to operate at conditions between about 250 and about 500 degrees centigrade to limit formation of mesophase pitch, said separation vessel including:

a vapor outlet to discharge a vapor phase from said separation vessel;

a liquid outlet to discharge a liquid phase from said separation vessel; and a laminar tube extending along an axis into said vessel interior, with said laminar tube configured to receive an effluent from the equilibrium channel and having an inner surface on which said liquid film layer is able to form, and having a coalescence portion including at least one chosen from a bend angled at least about 30 degrees relative to said axis and a pigtail forming at least one loop, and wherein said coalescence portion is arranged to direct said effluent toward said liquid outlet;

wherein said liquid phase includes isotropic pitch having a second softening point greater than said first softening point.

* * * * *